US011112101B1

(12) United States Patent
Jaslowski et al.

(10) Patent No.: US 11,112,101 B1
(45) Date of Patent: Sep. 7, 2021

(54) LIGHTING FIXTURE SYSTEM FOR ADJUSTABLY MOUNTING LIGHTING DEVICES

(71) Applicant: Group Dekko, Inc., Fort Wayne, IN (US)

(72) Inventors: Mike Jaslowski, Columbia City, IN (US); Rich Cook, Cumming, GA (US); Stephen Samson, North Augusta (CA)

(73) Assignee: Group Dekko, Inc., Fort Wayne, IN (US)

( * ) Notice: Subject to any disclaimer, the term of this patent is extended or adjusted under 35 U.S.C. 154(b) by 0 days.

(21) Appl. No.: 17/171,315

(22) Filed: Feb. 9, 2021

(51) Int. Cl.
*F21V 21/30* (2006.01)
*F21V 17/10* (2006.01)

(52) U.S. Cl.
CPC ..... *F21V 21/30* (2013.01); *F21V 17/107* (2013.01)

(58) Field of Classification Search
CPC ..... F21V 21/30; F21V 17/107
See application file for complete search history.

(56) References Cited

U.S. PATENT DOCUMENTS 5,309,541 A * 5/1994 Flint ..... G02B 6/102 359/365
5,658,066 A * 8/1997 Hirsch ..... F21V 21/005 362/219
6,530,674 B2 * 3/2003 Grierson ..... F21V 21/005 362/219
8,770,789 B2 * 7/2014 Smith ..... F21V 21/14 362/249.01

* cited by examiner

*Primary Examiner* — Thomas M Sember
(74) *Attorney, Agent, or Firm* — Taylor IP, P.C.

(57) ABSTRACT

A lighting fixture system that includes a plurality of lighting devices and an adjustable mounting assembly configured to mount the plurality of lighting devices to a support structure. The adjustable mounting assembly includes a plurality of lighting-device end caps and a link which includes at least one support attachment feature configured to connect to the support structure and a plurality of end-cap attachment features. The plurality of end-cap attachment features includes a first end-cap attachment feature configured to movably mount the first lighting-device end cap and a second end-cap attachment feature configured to movably mount the second lighting-device end cap.

20 Claims, 6 Drawing Sheets

LIGHTING FIXTURE SYSTEM FOR ADJUSTABLY MOUNTING LIGHTING DEVICES

BACKGROUND OF THE INVENTION

1. Field of the Invention

The present invention relates to lighting devices which are mounted to a ceiling, and, more particularly, to the fixtures for mounting such lighting devices.

2. Description of the Related Art

Some lighting fixture systems are used to hang or suspend lighting devices from a ceiling. A ceiling lighting fixture system typically includes multiple lighting devices and cables or chains which connect the lighting devices to the ceiling. The ceiling lighting fixture system may also include two or more interlinking members that are rigidly connected in between the ends of adjacent lighting devices. The interlinking members help to stabilize the lighting devices. An interlinking member is typically a bar which is rigidly fastened to the respective ends of adjacent lighting devices. However, although the interlinking members provide the necessary structural rigidity, the interlinking members prevent the possible design options or orientations of the lighting devices. For instance, the interlinking members may require that the lighting devices be connected to one another in a straight line and within the same plane.

What is needed in the art is a cost-effective lighting fixture system which securely mounts the lighting devices and provides multiple design options for the lighting devices.

SUMMARY OF THE INVENTION

The present invention provides an adjustable mounting assembly for mounting multiple lighting devices to a support structure. The adjustable mounting assembly includes a plurality of lighting-device end caps that includes a first lighting-device end cap connected to the end of the first lighting device and a second lighting-device end cap connected to the end of the second lighting device. The adjustable mounting assembly also includes a link that includes at least one support attachment feature configured to connect to the support structure and a plurality of end-cap attachment features. The plurality of end-cap attachment features includes a first end-cap attachment feature configured to movably mount the first lighting-device end cap and a second end-cap attachment feature configured to movably mount the second lighting-device end cap.

The invention in one form is directed to a lighting fixture system that includes a plurality of lighting devices which includes a first lighting device having an end and a second lighting device having an end, and an adjustable mounting assembly configured to mount the plurality of lighting devices to a support structure. The adjustable mounting assembly includes a plurality of lighting-device end caps which includes a first lighting-device end cap connected to the end of the first lighting device and a second lighting-device end cap connected to the end of the second lighting device. The adjustable mounting assembly also includes a link that includes at least one support attachment feature configured to connect to the support structure and a plurality of end-cap attachment features. The plurality of end-cap attachment features includes a first end-cap attachment feature configured to movably mount the first lighting-device end cap and a second end-cap attachment feature configured to movably mount the second lighting-device end cap.

The invention in another form is directed to an adjustable mounting assembly configured to mount a plurality of lighting devices to a support structure. The plurality of lighting devices includes a first lighting device having an end and a second lighting device having an end. The adjustable mounting assembly includes a plurality of lighting-device end caps comprising a first lighting-device end cap configured to be connected to the end of the first lighting device and a second lighting-device end cap configured to be connected to the end of the second lighting device. The adjustable mounting assembly also includes a link that includes at least one support attachment feature configured to connect to the support structure and a plurality of end-cap attachment features. The plurality of end-cap attachment features includes a first end-cap attachment feature configured to movably mount the first lighting-device end cap and a second end-cap attachment feature configured to movably mount the second lighting-device end cap.

The invention in yet another form is directed to a method for movably mounting a plurality of lighting devices to a support structure. The plurality of lighting devices includes a first lighting device which has an end and a second lighting device having an end. The method includes an initial step of providing an adjustable mounting assembly. The adjustable mounting assembly includes a plurality of lighting-device end caps which includes a first lighting-device end cap and a second lighting-device end cap, and a link that includes at least one support attachment feature and a plurality of end-cap attachment features. The plurality of end-cap attachment features includes a first end-cap attachment feature and a second end-cap attachment feature. The method also includes connecting the first lighting-device end cap to the end of the first lighting device and connecting the second lighting-device end cap to the end of the second lighting device. The method also includes movably mounting the first lighting-device end cap onto the first end-cap attachment feature and movably mounting the second lighting-device end cap onto the second end-cap attachment feature. The method further includes connecting the least one support attachment feature to the support structure.

An advantage of the present invention is that the adjustable mounting assembly dually secures the lighting device to a support structure and provides for multiple and easily adjustable design options for variously configuring the number of lighting devices and the angles of the lighting devices relative to each other.

Another advantage of the present invention is that the link of the adjustable mounting assembly may be readily interchanged to adjust the number of lighting devices which may be connected to the support structure at a single location.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
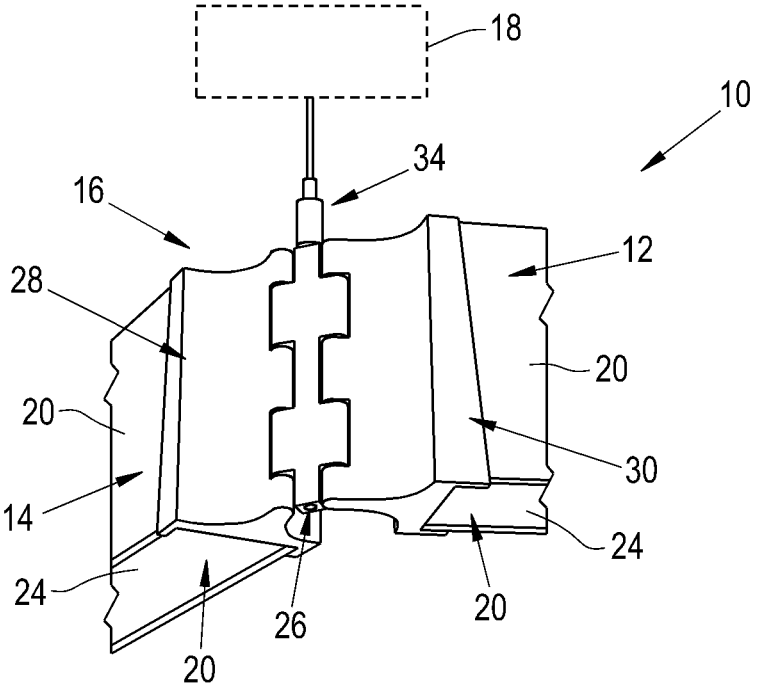
FIG. 1 is a perspective view of an embodiment of a lighting fixture system for mounting lights on a ceiling.
Figure 2:
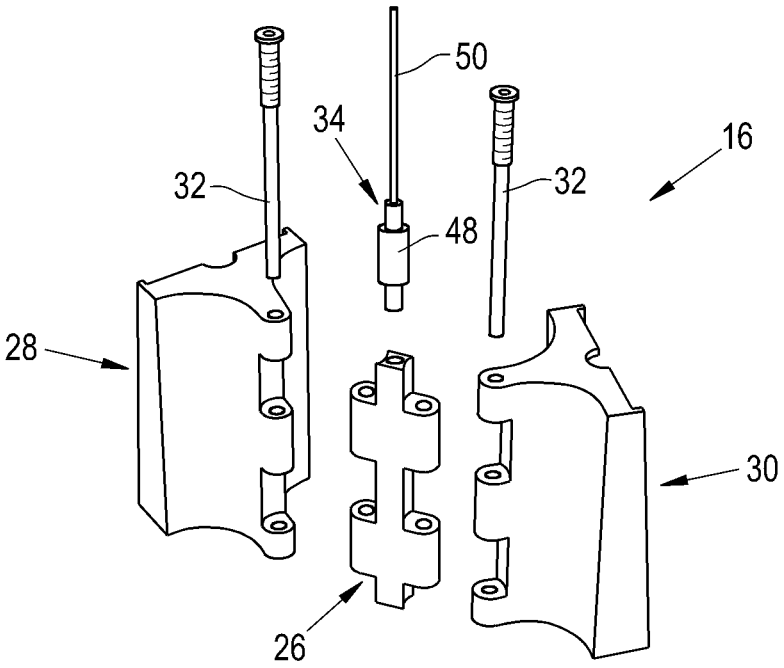
FIG. 2 is an exploded view of the lighting fixture system of FIG. 1.

Referring now to the drawings, and more particularly to FIGS. 1-7, there is shown an embodiment of a lighting fixture system 10. The lighting fixture system 10 generally includes multiple lighting devices 12, 14 and at least one adjustable mounting assembly 16 for movably or adjustably mounting the multiple lighting device 12, 14 to a support structure 18. The mounting assembly 16 serves as a dual-purpose connection point in order to mount the lighting devices 12, 14 to the support structure 18 and adjustably connect the lighting devices 12, 14 to each other.

It should be appreciated that each lighting device 12, 14 may be in the form of any desired light, such as a linear tube light or a series of light emitting diodes (LEDs). Each lighting device 12, 14 may include a frame 20 with ends 22, lights (not shown), and a cover 24 (FIG. 1). The lighting fixture system 10 may include two or more lighting devices 12, 14 which may be coupled together with at least one mounting assembly 16. It should also be appreciated that the support structure 18 may be in the form of any desired wall or structural member, such as a ceiling, scaffolding, or any other framework for mounting lighting devices.

The mounting assembly 16 is configured to couple to the support structure 18. The mounting assembly 16 is also configured to adjustably connect the lighting devices 12, 14. One or more mounting assemblies 16 may be used to couple two or more lighting devices 12, 14. For instance, two, three, four, five, or more lighting devices 12, 14 may be coupled together via a single mounting assembly 16. The mounting assembly 16 generally includes a link 26, multiple lighting-device end caps 28, 30 that are movably connected to the link 26, fasteners 32 for moveably connecting the lighting-device end caps 28, 30 to the link 26, and a support structure mount 34.

The link 26 is connected to the support structure 18 and the lighting devices 12, 14 by way of the end caps 28, 30. Therein, the link 26 dually supports the lighting devices 12, 14, i.e., suspends the lighting devices 12, 14 relative to the support structure 18, and adjustably connects the lighting devices 12, 14 relative to each other. The link 26 may movably mount the end caps 28, 30 such that the lighting devices 12, 14 may swivel relative to the link 26. The link 26 may or may not have indexed positions for setting the lighting devices 12, 14 at given angles relative to each other. As shown, the link 26 does not include indexed positions. The link 26 may allow the lighting devices 12, 14 to swivel within a range of approximately 60 degrees, plus or minus 10 degrees. The link 26 can be the only link, i.e., single component, which couples the end caps 28, 30 of the two or more lighting devices 12, 14.

Figure 3:
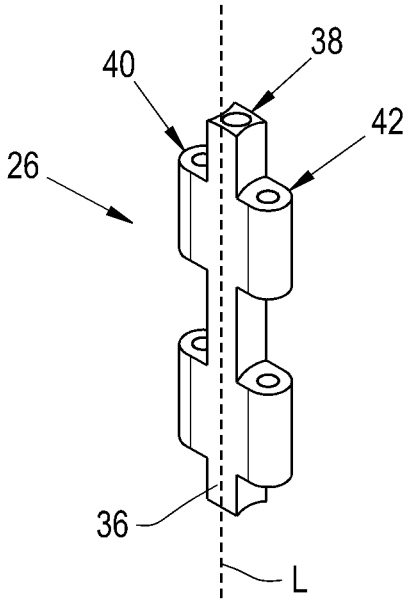
FIG. 3 is a perspective view of a link of the lighting fixture system of FIGS. 1-2 that is configured to mount two lighting devices.
Figure 4:
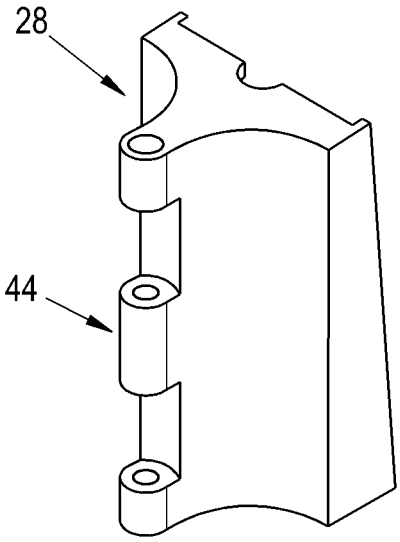
FIG. 4 is a perspective view of an end connector of the lighting fixture system of FIGS. 1-2.
Figure 5:
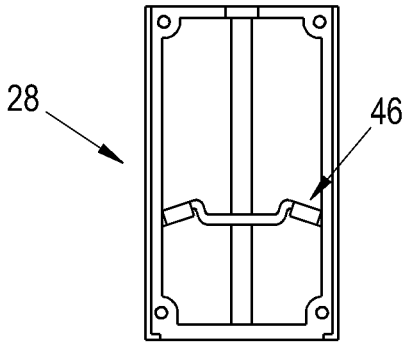
FIG. 5 is a rear view of the end connector of FIG. 4.
Figure 6:
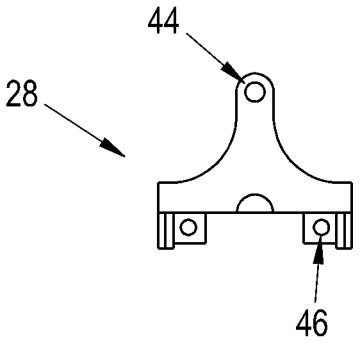
FIG. 6 is a top view of the end connector of FIGS. 4-5.
Figure 7:
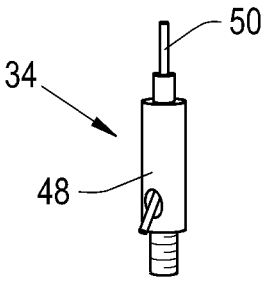
FIG. 7 is a side view of a threaded fixture of the lighting fixture system of FIGS. 1-2.

The link 26 includes a body with a stem 36, at least one support attachment feature 38 configured to connect to the support structure 18, and multiple end-cap attachment features 40, 42 located adjacent to the stem 36 and configured to adjustably mount the end caps 28, 30 (FIG. 3). As shown, the link 26 includes two end-cap attachment features 40, 42 which correspond to the two end caps 28, 30. The body may be in the form of a monolithic body which is composed of a single material. The body may comprise any desired material, for example a ferrous, a non-ferrous, or a plastic material. The stem 36 may define a longitudinal axis L. The at least one support feature 38 may be in the form of a threaded hole 38 for receiving the support structure mount 34. The threaded hole 38 may be located at the top of the stem 36. Each end-cap attachment feature 40, 42 may be in the form of at least one through hole 40, 42 which is parallel to the longitudinal axis L of the stem 36. For instance, each end-cap attachment feature 40, 42 may comprise two through holes 40, 42 which are located at the top and bottom of each side of the stem 36. Each through hole 40, 42 of the link 26 may or may not be threaded.

The lighting-device end caps 28, 30 are connected to the ends 22 of the lighting devices 12, 14. Each lighting-device end cap 28, 30 may comprise a body with a link attachment feature 44 located at the front of the body to engage with the link 26 and a lighting-device attachment feature 46 located at the rear of the body to engage with the lighting device 12, 14 (FIGS. 4-6, wherein only the lighting-device end cap 28 is shown). The body of each lighting-device end cap 28, 30 may have sides with an inwardly curved profile which help to allow a lighting device 12, 14 to rotate relative to the link 26. The body of each lighting-device end cap 28, 30 may comprise any desired material, for example a ferrous, a non-ferrous, or a plastic material. The link attachment feature 44 may comprise at least one through hole 44. For instance, the link attachment feature 44 may comprise three through holes 44 which correspond to a respective set of through holes 40 or 42 of the link 26. Therein, the end cap through holes 44 and the corresponding link through holes 40 or 42 may align and interlock with one another so that the fasteners 32 may be fitted therein. Each through hole 44 may or may not be threaded. Therein, only the top through hole may be threaded. The lighting-device attachment feature 46 may comprise one or more holes for receiving fastener(s) therein for fixing the end cap 28, 30 onto the frame 20 of a lighting device 12, 14.

The fasteners 32 may couple the lighting-device end caps 28, 30 to the link 26. For instance, each fastener 32 may moveably connect each lighting-device end cap 28, 30 to the link 26 so that the lighting devices 12, 14 may rotate or swivel relative to the link 26. Each fastener 32 may be in the form of any desired fastener(s), such as a pin, a pin with a screw, and/or a threaded pin. As can be appreciated, the fasteners 32 may secure or otherwise rigidly fix the lighting-device end caps 28, 30 to the link 26. Thereby, a user by initially set a desired angle, secure the lighting-device end caps 28, 30 with the fasteners 32, and subsequently adjust the angle as desired by at least partially unfastening the fasteners, moving the lighting device(s) 12, 14, and refastening the fasteners 32.

The support structure mount 34 is configured to connect the link 26 to the support structure 18. The support structure mount 34 is connected to the at least one support attachment feature 38. The support structure mount 34 can be in the form of a threaded cable gripper 48 and a cable 50. The cable gripper 48 may fasten onto the at least one support attachment feature 38. The cable gripper 48 may have a threaded end and a receiving hole for receiving the cable 50. The cable 50 can be connected in between the support structure 18 and the cable gripper 48. The cable 50 can be removably or fixedly connected to the cable gripper 48. The cable 50 can also be removably or fixedly connected to the support structure 18.

A user may install the lighting devices 12, 14 on a support structure 18 with one or more mounting assemblies 16 by conducting the following method. During installation, the user may connect the lighting-device end caps 28, 30 onto respective ends 22 of the lighting devices 12, 14. Then, the user may movably mount the lighting-device end caps 28, 30 onto the respective end-cap attachment features 40, 42 of the link 26. In so doing, the user may align the corresponding attachment features 40, 42, 44 and insert the fastener 32 therein. Thereafter, the may move, e.g. rotate, the lighting device(s) 12, 14 as desired. The user may also connect the least one support attachment feature 38 to the support structure 18. In so doing, the user may connect the support structure mount 34 in between the at least one support attachment feature 38 and the support structure 18.

Figure 8:
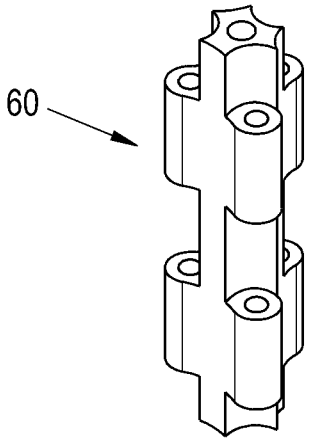
FIG. 8 is a perspective view of another embodiment of a link which is configured to mount three lighting devices.
Figure 9:
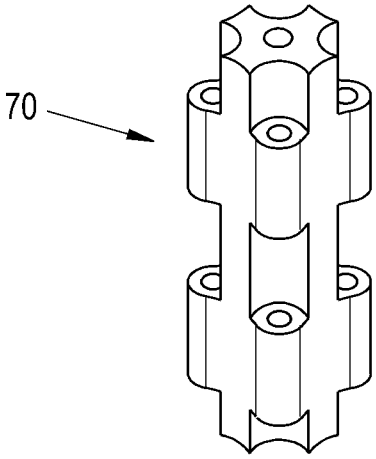
FIG. 9 is a perspective view of another embodiment of a link which is configured to mount four lighting devices.
Figure 10:
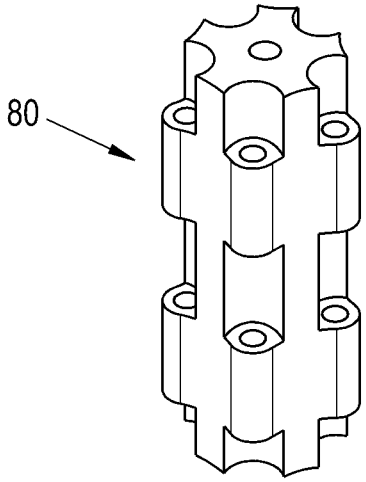
FIG. 10 is a perspective view of another embodiment of a link which is configured to mount five lighting devices.

Referring now to FIGS. 8-10, the link 26 of the mounting assembly 16 may be variously configured to accommodate any desired number of lighting devices. FIG. 8 illustrates a link 60 with three attachment features for mounting three end caps of three respective lighting devices. FIG. 9 illustrates a link 70 with four attachment features for mounting four end caps of four respective lighting devices. FIG. 10 illustrates a link 80 with five attachment features for mounting five end caps of five respective lighting devices. As can be appreciated, the links may be substantially similar to the link 26, as discussed above, except for the differing number of attachment features.

Figure 11:
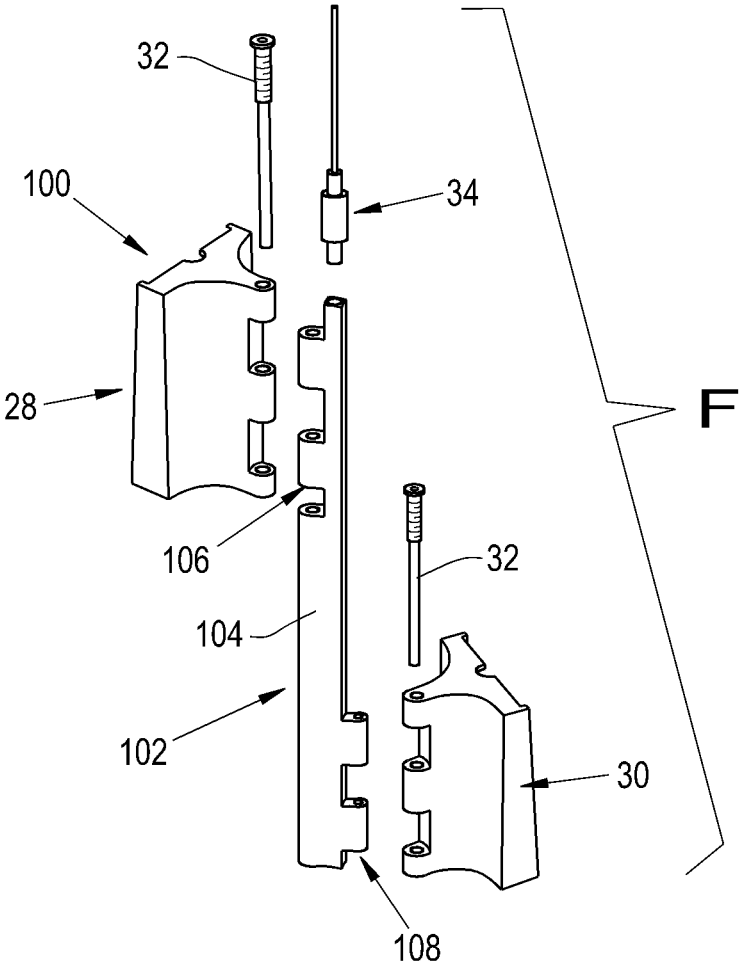
FIG. 11 is an exploded view of another embodiment of a lighting fixture system that includes a multiplane link for mounting multiple lighting devices in differing planes.
Figure 12:
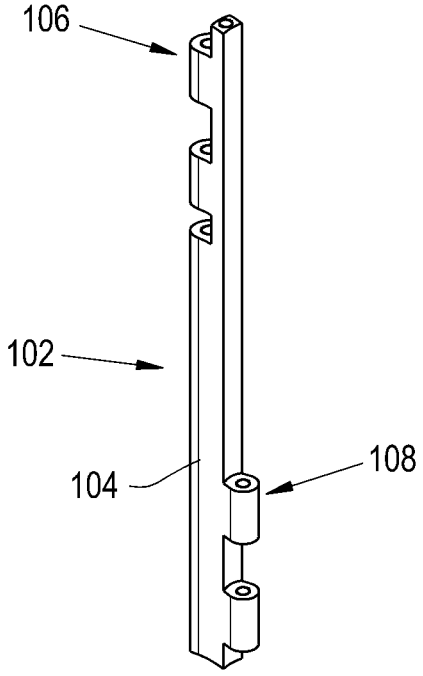
FIG. 12 is a perspective view of the multiplane link of the lighting fixture system of FIG. 11.

Referring now to FIGS. 11-12 there is shown another embodiment of an adjustable mounting assembly 100 which allows the lighting devices 12, 14 (not shown) to be mounted in different planes. The mounting assembly 100 may be substantially similar to the mounting assembly 16, as discussed above, except that the link 102 is in the form of a multiplane link 102. The link 102 includes a body with an elongated stem 104 which positions the end-cap attachment features 106, 108 apart from one another such that the lighting devices 12, 14 reside in different planes. Like elements have been identified with like reference characters.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lighting fixture system, comprising:

a plurality of lighting devices comprising a first lighting device having an end and a second lighting device having an end; and an adjustable mounting assembly configured to mount the plurality of lighting devices to a support structure, the adjustable mounting assembly comprising:

a plurality of lighting-device end caps comprising a first lighting-device end cap connected to the end of the first lighting device and a second lighting-device end cap connected to the end of the second lighting device; and a link comprising at least one support attachment feature configured to connect to the support structure and a plurality of end-cap attachment features, the plurality of end-cap attachment features comprising a first end-cap attachment feature configured to movably mount the first lighting-device end cap and a second end-cap attachment feature configured to movably mount the second lighting-device end cap.

2. The lighting fixture system of claim 1, wherein the link is the only link connected in between the first lighting-device end cap and the second lighting-device end cap.

3. The lighting fixture system of claim 1, wherein the link comprises a stem which defines a longitudinal axis, wherein the first end-cap attachment feature and the second end-cap attachment feature are located adjacent to the stem.

4. The lighting fixture system of claim 3, wherein the first end-cap attachment feature and the second end-cap attachment feature each comprise one or more link through holes.

5. The lighting fixture system of claim 4, wherein the one or more link through holes are oriented parallel to the longitudinal axis of the stem.

6. The lighting fixture system of claim 4, wherein the first lighting-device end cap and the second lighting-device end cap each comprise one or more end-cap through holes which correspond to the one or more link through holes.

7. The lighting fixture system of claim 1, further comprising a first fastener and a second fastener configured to respectively couple the first lighting-device end cap and the second lighting-device end cap to the link.

8. The lighting fixture system of claim 1, further comprising a support structure mount connected to the at least one support attachment feature, the support structure mount being configured to connect the link to the support structure.

9. The lighting fixture system of claim 1, wherein the link comprises an elongated stem which is configured to mount the lighting devices in differing planes.

10. An adjustable mounting assembly configured to mount a plurality of lighting devices to a support structure, the plurality of lighting devices comprising a first lighting device having an end and a second lighting device having an end, the adjustable mounting assembly comprising:

a plurality of lighting-device end caps comprising a first lighting-device end cap configured to be connected to the end of the first lighting device and a second lighting-device end cap configured to be connected to the end of the second lighting device; and a link comprising at least one support attachment feature configured to connect to the support structure and a plurality of end-cap attachment features, the plurality of end-cap attachment features comprising a first end-cap attachment feature configured to movably mount the first lighting-device end cap and a second end-cap attachment feature configured to movably mount the second lighting-device end cap.

11. The adjustable mounting assembly of claim 10, wherein the link is the only link connected in between the first lighting-device end cap and the second lighting-device end cap.

12. The adjustable mounting assembly of claim 10, wherein the link comprises a stem which defines a longitudinal axis, wherein the first end-cap attachment feature and the second end-cap attachment feature are located adjacent to the stem.

13. The adjustable mounting assembly of claim 12, wherein the first end-cap attachment feature and the second end-cap attachment feature each comprise one or more link through holes.

14. The adjustable mounting assembly of claim 13, wherein the one or more link through holes are oriented parallel to the longitudinal axis of the stem.

15. The adjustable mounting assembly of claim 13, wherein the first lighting-device end cap and the second lighting-device end cap each comprise one or more end-cap through holes which correspond to the one or more respective link through holes.

16. The adjustable mounting assembly of claim 10, further comprising a first fastener and a second fastener configured to respectively couple the first lighting-device end cap and the second lighting-device end cap to the link.

17. The adjustable mounting assembly of claim 10, further comprising a support structure mount connected to the at least one support attachment feature, the support structure mount being configured to connect the link to the support structure.

18. The adjustable mounting assembly of claim 10, wherein the link comprises an elongated stem which is configured to mount the lighting devices in differing planes.

19. A method for movably mounting a plurality of lighting devices to a support structure, the plurality of lighting devices comprising a first lighting device having an end and a second lighting device having an end, the method comprising:

providing an adjustable mounting assembly comprising a plurality of lighting-device end caps comprising a first lighting-device end cap and a second lighting-device end cap, and a link comprising at least one support attachment feature and a plurality of end-cap attachment features, the plurality of end-cap attachment features comprising a first end-cap attachment feature and a second end-cap attachment feature;

connecting the first lighting-device end cap to the end of the first lighting device;

connecting the second lighting-device end cap to the end of the second lighting device;

movably mounting the first lighting-device end cap onto the first end-cap attachment feature;

movably mounting the second lighting-device end cap onto the second end-cap attachment feature; and connecting the least one support attachment feature to the support structure.

20. The method of claim 19, wherein the link is the only link connected in between the first lighting-device end cap and the second lighting-device end cap.

* * * * *